US007074200B1

(12) United States Patent
Lewis

(10) Patent No.: US 7,074,200 B1
(45) **Date of Patent: *Jul. 11, 2006**

(54) EXTERNAL PULSATION UNIT CUFF

(76) Inventor: Michael P. Lewis, 4295 San Felipe, Suite 250, Houston, TX (US) 77027-2915

( * ) Notice: Subject to any disclaimer, the term of this patent is extended or adjusted under 35 U.S.C. 154(b) by 286 days.

This patent is subject to a terminal disclaimer.

(21) Appl. No.: 10/606,982

(22) Filed: Jun. 26, 2003

Related U.S. Application Data

(63) Continuation of application No. 09/733,276, filed on Dec. 8, 2000, now Pat. No. 6,620,116.

(51) Int. Cl.
*A61H 11/02* (2006.01)

(52) U.S. Cl. ..... 601/152; 601/44

(58) Field of Classification Search ..... 601/41, 601/44, 148–152; 128/DIG. 20
See application file for complete search history.

(56) References Cited

U.S. PATENT DOCUMENTS

| | | | | |
|---|---|---|---|---|
| 891,181 | A | 6/1908 | Michell | |
| 3,303,841 | A | 2/1967 | Dennis | |
| 4,375,217 | A * | 3/1983 | Arkans | 601/152 |
| 4,753,226 | A | 6/1988 | Zheng et al. | |
| 5,174,281 | A | 12/1992 | Lee | |
| 5,554,103 | A | 9/1996 | Zheng et al. | |
| 5,769,800 | A | 6/1998 | Gelfand et al. | |
| 5,997,540 | A | 12/1999 | Zheng et al. | |
| 6,010,471 | A | 1/2000 | Ben-Noon | |
| 6,736,785 | B1 * | 5/2004 | Van Brunt | 601/44 |

OTHER PUBLICATIONS

"External Counterpulsation Treatment of Refractory Angina" from the Mayo Clinic web site: http://www.mayoclinic.org/cardiovascular-rst/external.html Apr. 21, 2003.*

* cited by examiner

*Primary Examiner*—Danton DeMille
(74) *Attorney, Agent, or Firm*—Keeling Patents & Trademarks; Kenneth A. Keeling

(57) ABSTRACT

This invention is an improved medical device for non-invasive pulsation, including counterpulsation or simultaneous pulsation, treatment of heart disease and circulatory disorder through external cardiac assistance. The device is a cuff which is affixed on a patient's lower body and extremities, and which constricts or expands by electromechanical activation, thereby augmenting blood pressure for treatment purposes. The cuff contains preferably fixed volume fluids such as gel, air, or water. The cuff envelops and is affixed to the patient's lower body and limbs. In an alternative embodiment, the cuff creates a fixed volume of air between the cuff and the patient such that the cuff creates a vacuum when expanding, thereby stimulating return of blood to the constricted region, permitting better and/or faster responses.

18 Claims, 8 Drawing Sheets

24
9
10
5
1
5D
22
7
6
4
10
9

11
1
5C
21
2
3C
3
3A
3B
6
7
11

6
7
1
8

1
7
6
8

EXTERNAL PULSATION UNIT CUFF

CROSS-REFERENCE TO RELATED APPLICATIONS

This is a continuation under 37 CFR 1.53(b) to application Ser. No. 09/733,276, "External Counterpulsation Unit," filed on Dec. 8, 2000 now U.S. Pat. No. 6,620,116 by Michael P. Lewis, The parent application is under examination in Group Art Unit 3764 by Examiner Danton DeMille.

STATEMENT REGARDING FEDERALLY SPONSORED RESEARCH OR DEVELOPMENT

Not applicable.

FIELD OF THE INVENTION

The present invention is an improved medical cuff for non-invasive pulsation, including counterpulsation or simultaneous pulsation, treatment of patients utilizing at least one electromechanically controlled cuff wherein said cuff contains a fixed volume of a fluid such as air, water, or gel, and which constricts and expands upon electrical activation based on an integral actuator unit.

BACKGROUND OF THE INVENTION & RELATED ART

There are a variety of medical conditions in which the heart cannot pump sufficient blood to meet the body's normal requirements for nutrients and oxygen. Congestive heart failure is one condition in which the heart cannot pump enough blood to meet the needs of the body's other organs. Cardiac output can be too low for a variety of reasons, including coronary artery disease, endocarditis and myocarditis, diabetes, obesity, past heart attacks, high blood pressure, congenital defects, valve disease, or thyroid disease, to name a few. Where cardiac output falls, blood returning to the heart through veins can accumulate before the heart, causing fluid accumulation in the tissues. When cardiac output is too low, the body may take compensatory action including retention of salt by the kidneys. In response to salt retention, the body may retain greater quantities of water to balance sodium, and excess fluids can escape from the circulatory system causing edema (swelling) in other parts of the body. Edema is one of many complications arising from reduced cardiac output and congestive heart failure. The present invention is useful in treating edema, congestive heart failure and reduced cardiac output. Coronary artery disease is another condition that results in insufficient quantities of blood being pumped. Angina pectoris is a condition resulting from coronary artery disease. The present invention is useful in treating both coronary artery disease and angina pectoris.

There have been various devices in the prior art to treat patients through the use of non-invasive units and pulsation, but they are limited in their mechanical operation, precision of operation, stimulation of blood flow, and have failed to address concerns of the present invention.

External counterpulsation developed as a means of treating reduced cardiac output and circulatory disorder stemming from disease. Counterpulsation treatment involves the application of pressure, usually from distal to proximal portions of a patient's extremities, where such application is synchronized with heart rhythms. The treatment augments blood pressure, typically increasing pressure during the diastolic phase of the heart, as such treatment is known to relieve and treat medical conditions associated with reduced cardiac output. Clarence Dennis described an early hydraulic external counterpulsation device and method of its use in U.S. Pat. No. 3,303,841 (Feb. 14, 1967). Dr. Cohen, in American Cardiovascular Journal (30(10) 656–661, 1973) described another device for counterpulsation that made use of balloons which would sequentially inflate and deflate around the limbs of a patient to augment blood pressure. Similar devices using balloons have been described in Chinese patents CN 85200905 (U.S. Pat. No. 4,753,226); Chinese patents CN 88203328, and CN 1057189A.

A series of Zheng patents, including U.S. Pat. No. 4,753,226 (Jun. 28, 1988), U.S. Pat. No. 5,554,103 (Sep. 10, 1996), and U.S. Pat. No. 5,997,540 (Dec. 7, 1999) disclose counterpulsation devices employing sequential inflation of balloon cuffs around the extremities, wherein cuffs are inflated by fluid. All three Zheng patents disclose an external counterpulsation device where a series of air bladders are positioned within a rigid or semi-rigid cuff around the legs. The bladders are sequentially inflated and deflated with fluid, such that blood pressure is augmented in the patient. The Zheng '103 and Zheng '540 patents provide for cooled fluid and for monitoring of blood pressure and blood oxygen saturation; however, both retain a similar mechanism dependent on compression of fluid such as air or water. The Zheng '540 modifies the shape of the air bladder and cuffs, but retains a similar mechanism requiring rapid fluid distribution, influx and efflux through balloons in the cuffs.

Deficiencies with the prior counterpulsation cuffs include the requirement of a relatively heavy and noisy compressor and fluid reservoirs for inflating and deflating the cuffs; a lack of portability due to the size and weight of the apparatus; and the need for more than a 120 volt current. There are deficiencies with regard to patients being bounced up and down while subjected to the treatment. Additionally, because the prior art requires circuitous movement of fluid through the apparatus, there is a consequent lack of ability to manipulate action of the cuffs with a high degree of precision. Moreover, as the cuff returns only to an original position of contact with the patient's skin, blood-flow through the cuffed extremity is not fully encouraged.

BRIEF SUMMARY OF THE INVENTION

It is therefore the object of the present invention to provide a pulsation, including counterpulsation or simultaneous pulsation, cuff that compresses by electromechanical, rather than by pneumatic, means wherein said means is integral to the cuff, and which can be precisely controlled by the operator. It is a further object of the invention that the cuff may be constructed to create a vacuum about the extremity so as to encourage blood flow after constriction. It is a further object of the invention that the cuff may be expanded from its initial size so as to stimulate expansion of blood vessels by application of a vacuum against the extremity. It is a further object of the invention that the cuff transmits data regarding local pressure. It is a further object of the invention that after application the cuff be adjustable such that the cuff may apply fixed pressure, positive or negative, less than the maximum pressure, positive or negative, at times during operation.

The present invention provides a cuff with integral actuators and which may be constructed so as to encourage blood flow after constriction.

The present invention allows the operator to vary the constriction pressure and vacuum level applied by each cuff with a high degree of precision. This improvement is in contrast to prior art which uses the same pressure in multiple cuffs.

The present invention allows the operator to vary the duration and strength of compression, relaxation and expansion of each cuff.

The present invention provides a more comfortable cuff for patients as they are not repeatedly bounced up and down by inflation and deflation, and because the noise level of the apparatus is significantly reduced by use of electromechanical cuff actuators.

In the preferred embodiment, the present invention provides a more accessible treatment due to its portability, significantly reduced weight, and ability to run on a 120 volt current.

DETAILED DESCRIPTION OF THE INVENTION

Figure 1:
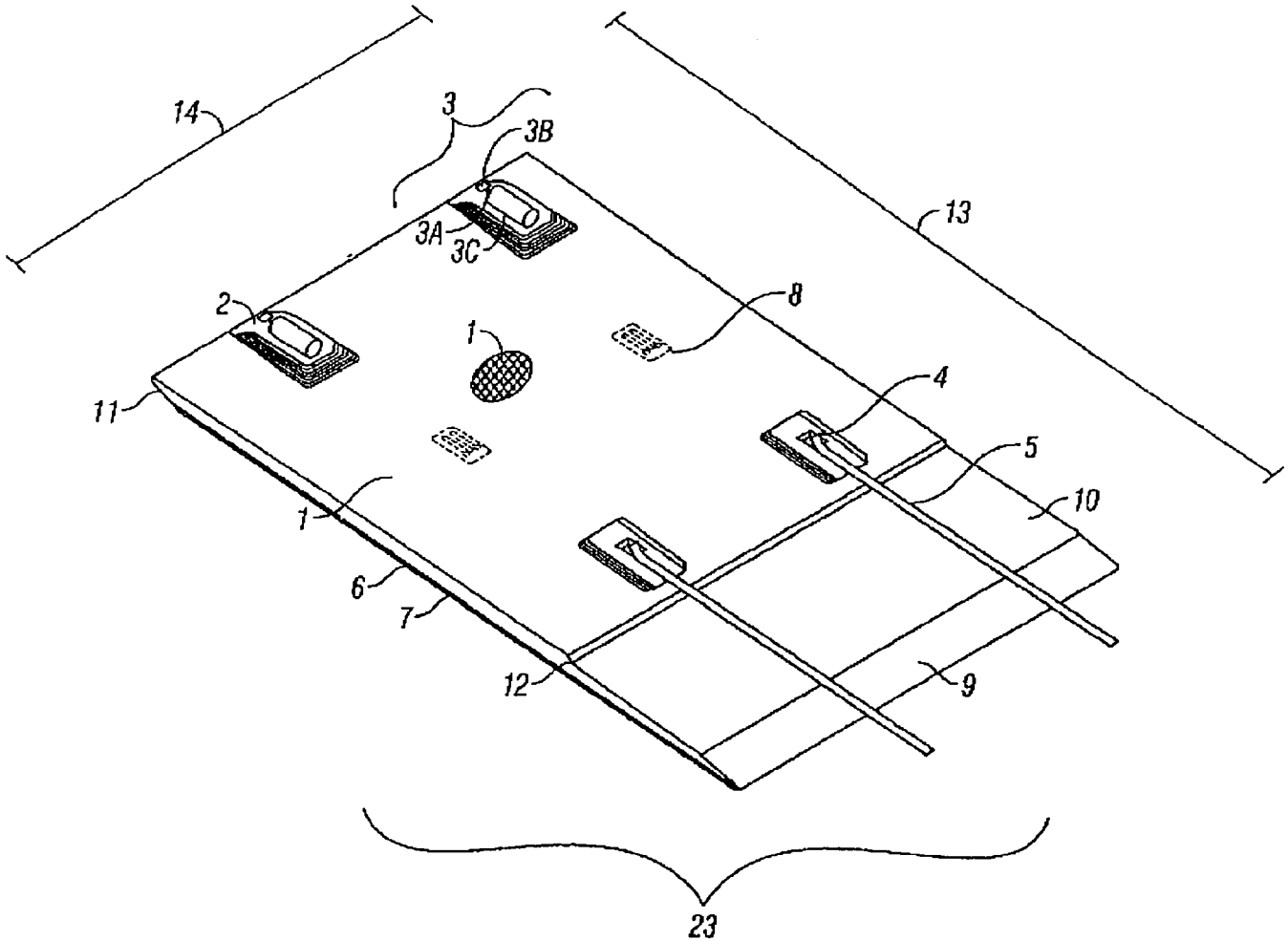
FIG. 1 is an isometric view of an unfastened electromechanical actuator cuff used in pulsation, including counterpulsation or simultaneous pulsation, treatment and designed for affixation to a patient's extremities.

This invention is a cuff for use in external pulsation, including counterpulsation or simultaneous pulsation treatment of reduced cardiac output, congestive heart failure, angina pectoris, heart disease and other circulatory disorders. Counterpulsation has traditionally involved the application of sequential pressures on the lower legs, upper legs and buttocks through pneumatic cuffs placed on those regions. Application of pressure to the extremities has been timed to correlate with a patient's physiological rhythms, such as diastolic and systolic phases of the heart. This application of force by the cuff pushes blood upward toward the heart, whereby blood pressure is increased during the diastolic phase of the heart. This enhanced pressure is recognized as medically beneficial for treatment of medical conditions relating to blood circulation. The present invention, however, does not make use of pneumatic or inflatable devices for application of pressure. Rather, the present invention is an electromechanically controlled cuff that compress on activation and applies pressure to a patient's body wherein the actuator is integral to the cuff. Rather than pneumatic or inflatable devices, the present invention uses constriction means attached to the cuff; the cuff is typically filled with fluid, air, gel, or foam material. The cuff is primarily a flat structure designed to radially envelope an extremity such as a leg, arm, or midsection of a body. When the extremity is enveloped, the cuff is secured to itself in a manner such that electrical activation of actuators on the cuff will cause the cuff to constrict, thereby applying pressure to the extremity or portion of the body to which it is affixed, relax thereby applying no pressure, or expand, thereby creating a vacuum against the extremity of portion of the body to which it is affixed. Electromechanical means for constriction/expansion of the cuff is preferably one or more solenoid actuators (linear or rotary) connected at one end of the cuff and attached to a rod or rigid strap connected at the opposite end of the cuff. In an alternative embodiment, the electromechanical means on a first cuff section may be connected to the end of a mating cuff section thereby creating a full cuff. Positive pressure from the cuff forces blood from the extremity toward the patient's heart during diastole. It is this augmentation of blood pressure during diastole that provides curative benefit from counterpulsation treatment. Typically, the cuff will release immediately prior to the systolic phase of the patient's heart. In an alternative embodiment, a further improvement over the prior art is the use of the electromechanical means for expansion of the cuff to create a vacuum adjacent the skin to promote blood circulation between constrictions. A vacuum is created by creating a seal at each edge of the cuff with the adjacent skin and a seal at the overlapping sections of the cuff, then expanding the electromechanical means to a point beyond the original location.

Because the clinician may adjust the sequence in which the actuators are activated, blood can be forced away from the heart to a foot or hand. This is beneficial when treating a diabetic patient with poor blood circulation to these extremities.

FIG. 1 represents a single section electromechanical actuator cuff 23 used with the present invention and for use with pulsation, including counterpulsation or simultaneous pulsation, treatment. The cuff is actuated to apply pressure, positive or negative, according to treatment parameters and correlate with the patient's physiological data, such as diastolic and systolic phases of the heart, to augment blood pressure as necessary. The pressure strength, pressure duration, and delay between activations can be varied separately for each cuff and individual actuator used in treatment. The actuators on the cuff can apply pressure in many combinations of sequence, amount of pressure, and duration. Three preferable manners are: first, where pressure is graded, second where pressure is applied sequentially and third where graded pressure is applied sequentially. Pressure strength, pressure duration, and delay between actions can also be varied upon relaxation of the cuff and individual actuators. The actuators on the cuff relax in three preferable manners: first where pressure is graded, second where pressure is relaxed sequentially and third where graded pressure is relaxed sequentially. Pressure on a patient can also be released by all actuators simultaneously or in any sequence.

Graded pressure means that each cuff, or each actuator on each cuff, is set to apply a specific and not necessarily identical amount of pressure. For example, the cuff or actuators at a patient's calves may be set to apply pressure at a greater strength than the cuff or actuators affixed to a patient's thighs. In this manner, even where all actuators apply pressure simultaneously, pressure will vary at separate locations on the patient. Actuators are preferably adjusted so that pressure will increase or decrease from distal to proximal direction on a patient or vice versa. Each actuator and each cuff may also release pressure at variable sequences and at varying strengths. Pressure on a patient can be applied one actuator at a time, in any sequence, and at any pressure within treatment parameters.

An actuator cuff and individual actuators can apply sequential pressure to a patient. A cuff and actuators preferably apply pressure, positive or negative in sequence, from a distal to proximal direction or vice versa. An individual cuff or actuator may be removed from a sequence of activations, or can be set independently so that one cuff or one actuator in a series applies pressure, positive or negative, more frequently per period of time than will a separate cuff or individual actuator. Each cuff and individual actuators will preferably operate in sequence, whether or not there are gradations in pressure from actuator to actuator or from cuff to cuff.

Graded sequential pressure involves variations in constriction/vacuum force (pressure) from actuator to actuator or from cuff to cuff and where actuators or the cuff will operate in sequence. For example, actuators at a patient's calves may be set to apply greater pressure, positive or negative than actuators fixed to the cuff on a patient's hips. In addition to graded pressure, the actuators are set to activate in sequence starting from the patient's calves and moving upward to the actuator on the patient's hip. In this same example, actuators would relax in like sequence, thereby creating a precisely controlled peristaltic motion by the cuff on the patient.

The cuff applies pressure preferably in sequence on a patient from a distal to proximal direction generally with increments in the range of 35.0 to 50.0 milliseconds between initial activation of separate sequential cuffs. Each cuff preferably relaxes or applies negative pressure in sequence on a patient from a proximal to distal direction. All actuators on each of cuff preferably operate within a compression strength range of −1.0 and +7.0 pounds of pressure per square inch for each actuator. The cuff is also able to compress, relax, or expand in the opposite direction, from proximal to distal direction on the patient and in the same time increments.

FIG. 1 depicts an electromechanical actuator cuff designed for affixation to a patient's extremities (arms, legs). The preferable rectangular shape of the cuff can be varied by manufacture or adjustment to accommodate different body shapes and sizes. For instance, the actuator cuff depicted in FIG. 1 may be adapted in size to fit a calf, thigh, forearm, upper arm, or wrist of an infant, child, or adult patient. Additionally, each cuff in the present pulsation, including counterpulsation or simultaneous pulsation, unit is preferably adapted in a more conical or trapezoidal shape to accommodate increasing or decreasing thicknesses of patient extremities. Trapezoidal shaping improves the cuff's ability to encompass a patient's extremity and receive optimal benefit of actuator constriction and expansion.

Figure 6:
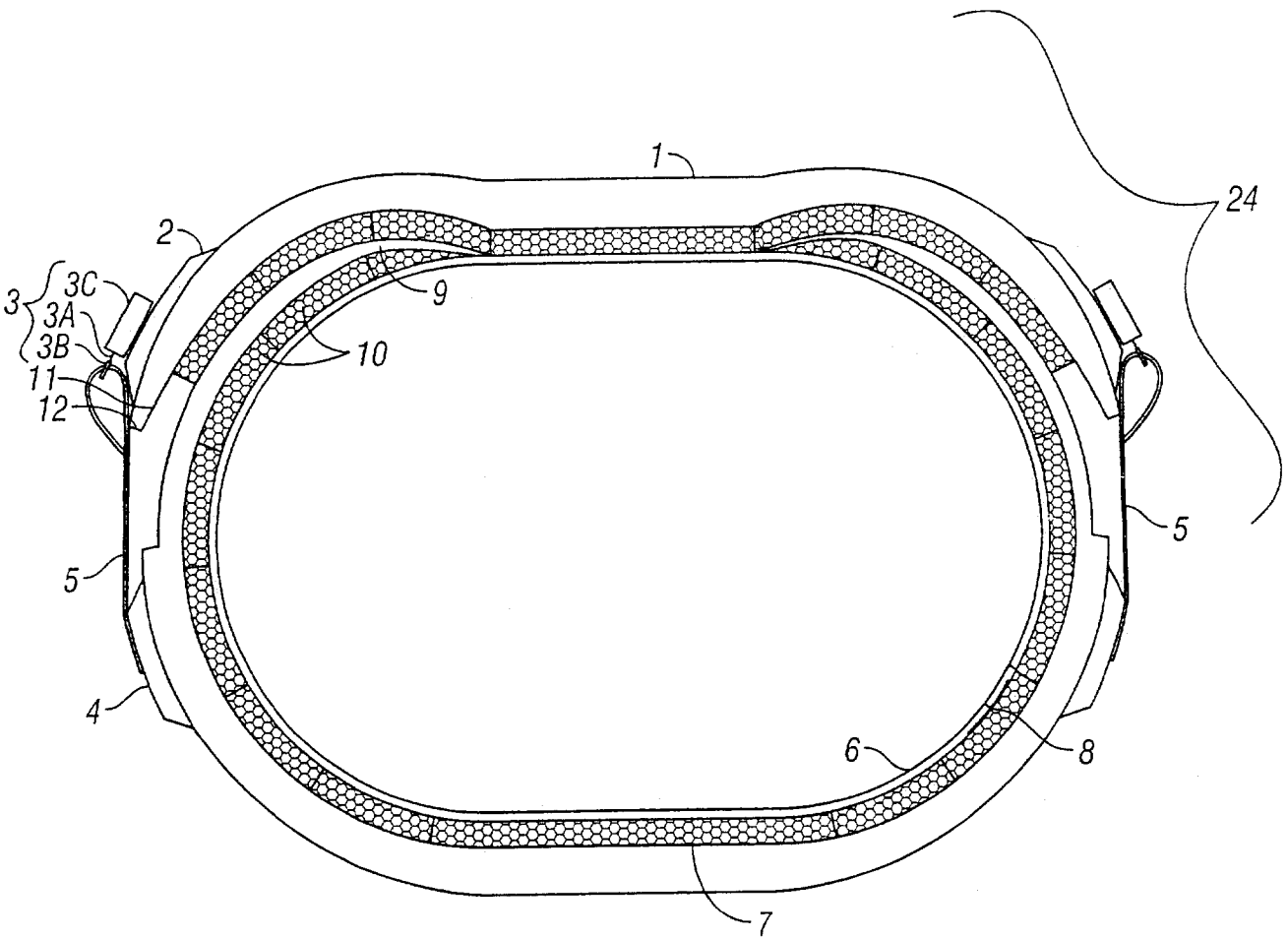
FIG. 6 is an end view of the electromechanical actuator cuff in FIGS. 4 and 5 as the cuff would appear during use.
Figure 6A:
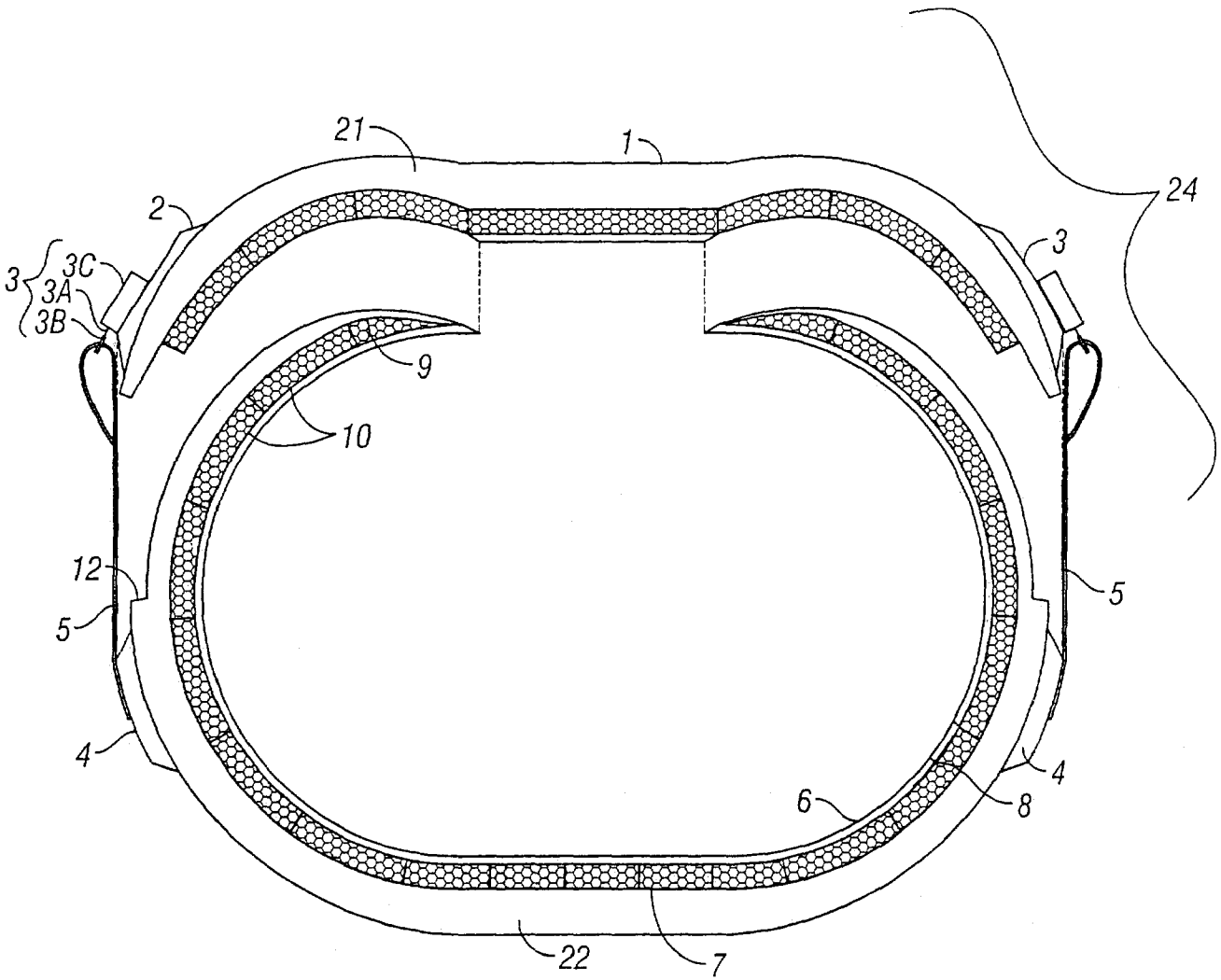

FIG. 6A depicts an exploded view of the embodiment of FIG. 6.

Figure 7:
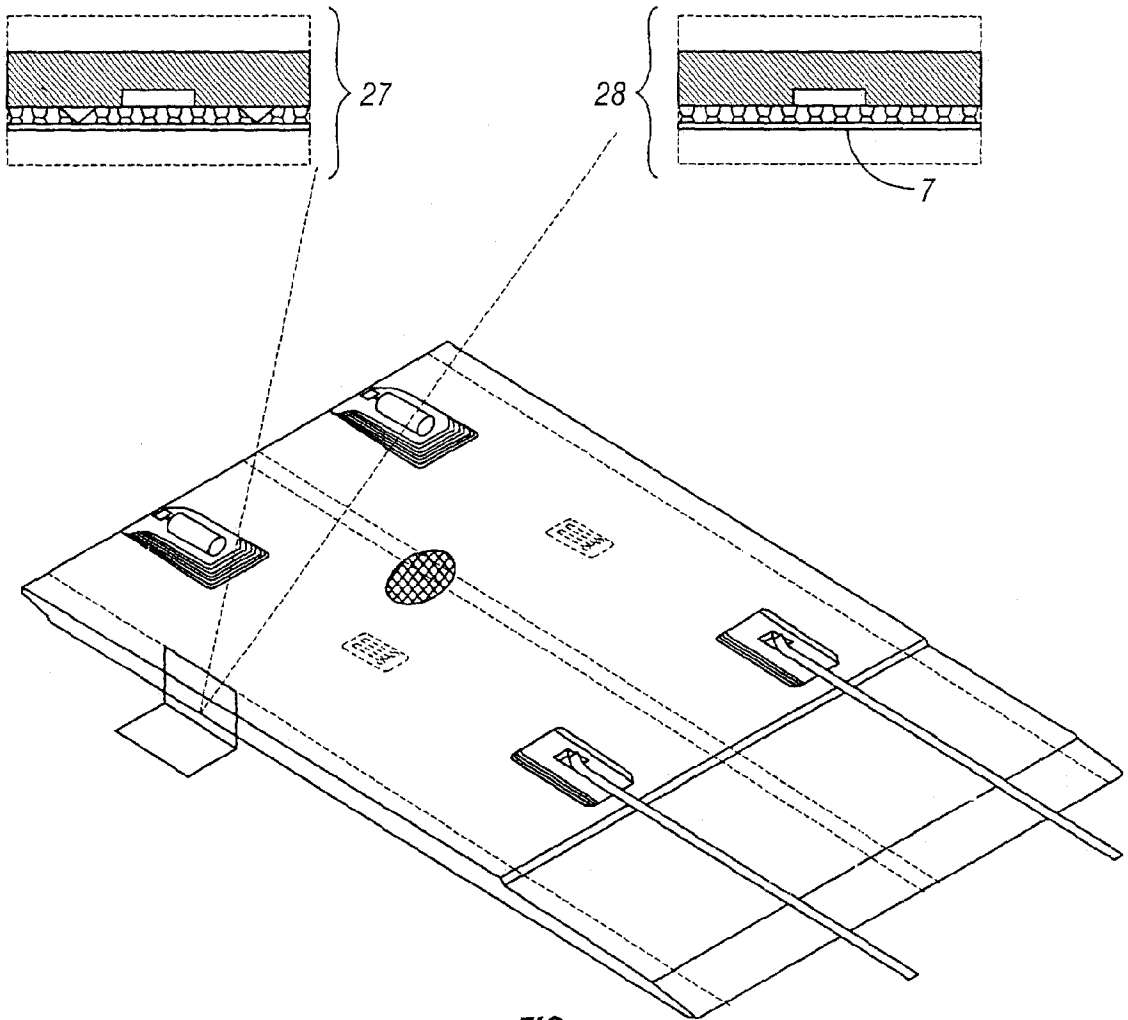
FIG. 7 depicts preferable orientations and constructions of flexible bladder sections used in the cuff of this invention.

FIG. 7 depicts a double section embodiment of the actuator cuff 24. The double section embodiment 24 is affixed to the patient's buttocks and hips. While more than one cuff can be operated simultaneously, each cuff and each of the actuators on each cuff can be operated separately with different or identical compression/expansion sequences, strengths, and delays between each individual actuator cuff or between individual actuator activation or relaxation. For instance, with the present invention, it would be possible to cause an actuator on a particular cuff to constrict more frequently in a set period of time than the other actuators on the same cuff. Additionally, the cuff of the present invention is able to apply pressure, positive or negative, to an extremity almost instantaneously from the time the activation signal is sent due to its electromechanical rather than pneumatic operation. Pressure can additionally be altered with a high degree of precision with the present invention. Counterpulsation typically relies on reduction of pressure on the patient's extremities during the systolic phase of the heart. Instead of instant deflation of all cuffs at systole, the present invention, which does not require deflation, can vary the time frames during systole and the degree of pressure on each cuff. The present invention, which does not rely on inflation or deflation, can more aptly gradually reduce pressure with each cuff and each individual cuff actuator.

Figure 2A:
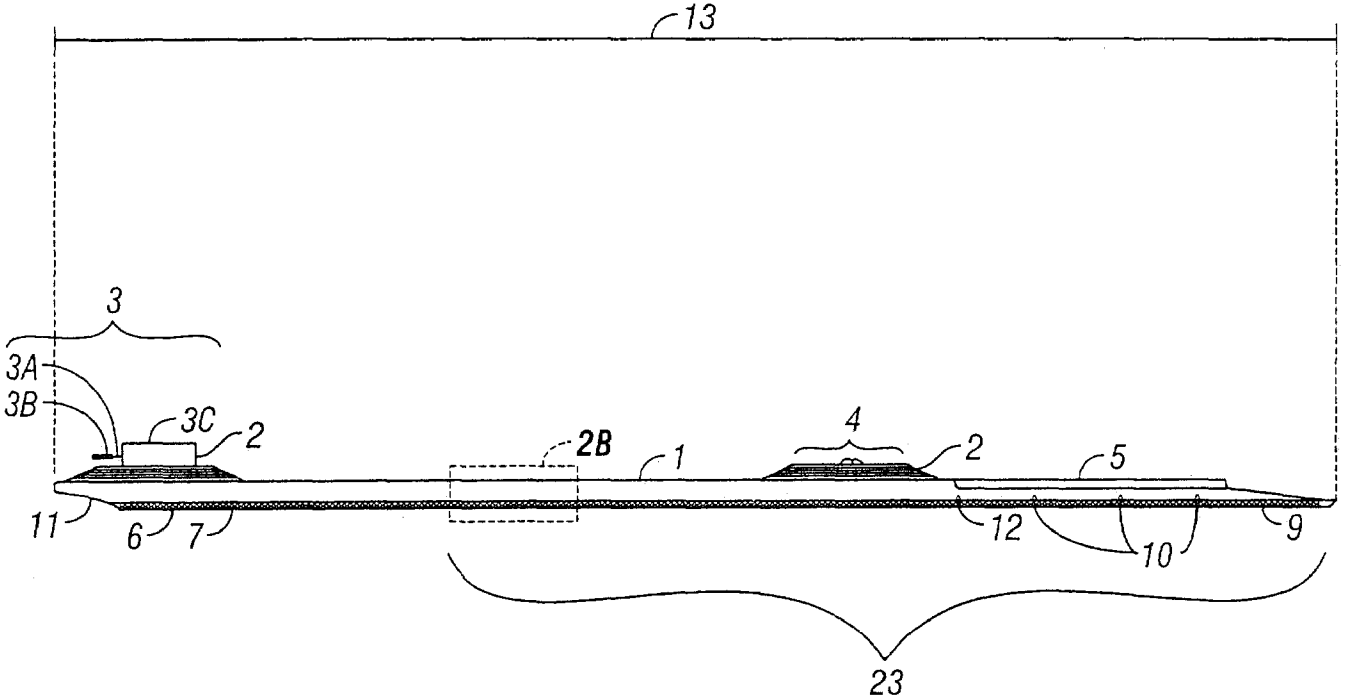
FIG. 2 is an end view of the electromechanical actuator cuff depicted in FIG. 1 and additionally has a sectional view of cuff construction at the top of the page.
Figure 2B:
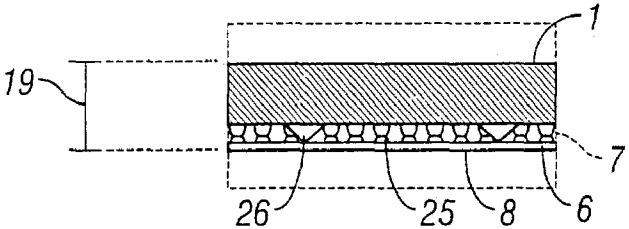

In FIG. 1 the dimensions of one embodiment of the electromechanical actuator cuff are depicted. The width 14 of the cuff depicted in FIG. 1 is in the range of 1.0 and 20.0 inches; the length 13 is in the range of 4.0 and 40.0 inches. The actuator cuff thickness 19 as shown in FIGS. 2A and 2B, means the sum measurement of a typical cuff construction, including flexible surface layer 1, flexible bladder section 7, and flexible liner layer 6 at its thickest point in the cuff in the range of 0.1 and 3.0 inches. The actuator cuff can be made of one material throughout its thickness, but typically has more than one layer, including a flexible surface layer 1 that is made of a material for flexibility, appearance, durability, and strength. This flexible surface layer 1 is typically of Kevlar, plastic, nylon, or aramid. The flexible surface layer 1, is preferably made from a resilient construction which will not have significant stretch within the range and duration of the unit's operation. Flexible layer 1 may be made of a material that has sufficient resistance to deflection so as to provide all energy needed to create negative pressure between the cuff and skin upon cessation of positive pressure by the actuator unit. In an alternative embodiment the rod or rigid strap would be eliminated by such material used to create negative pressure against the skin before operation.

As depicted in all figures, contiguous with the bottom of flexible surface layer 1 is typically a flexible bladder section 7, which contains a fixed volume of fluid substance. Flexible bladder section 7 preferably contains a fluid such as air, gel, foam substance, beads (typically plastic), or water. Bladder section 7 is flexible to bend with the actuator cuff on compression or expansion. The bladder section 7 may be filled with fluid prior to use of the cuff, however, it does not inflate or deflate upon activation of the cuff. Bladder section 7 is preferably comprised of a plurality of bladder subsections 25 (shown in FIG. 2B), which run along the width of a cuff, and with empty cavities 26 between each subsection 25. These bladder subsections 25 and empty cavities 26 further enhance flexibility of the bladder section 7 and cuff as it constricts or expands during operation. A pressure sensor and/or a pressure relief valve (not shown) may be constructed at the point at which the bladder in inflated and deflated. Inflation of the bladder permits the cuff to better conform to the contour of the area upon which it is placed and to provide a heat-absorbent enclosure. A pressure sensor may provide data to an external control unit for adjustment of the positive or negative pressure applied to the patient. A pressure relief value prevents damaging overcompression of the patient by the cuff.

Figure 3:
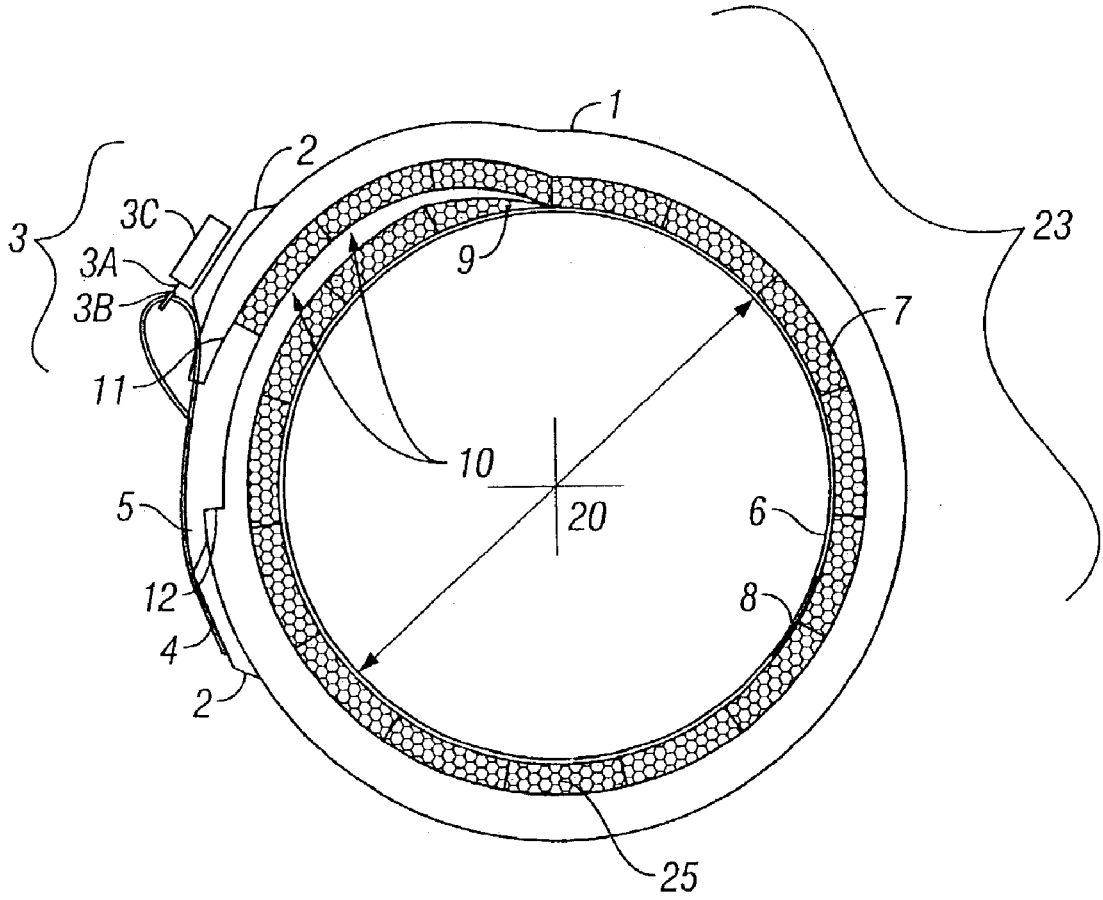
FIG. 3 is an end view of the electromechanical actuator cuff in FIGS. 1 and 2 as the cuff would appear fastened during use.

FIG. 3 is an end view of the electromechanical actuator cuff depicted in FIG. 1. It provides a more detailed picture and sectional view of the flexible surface layer 1 as it is preferably positioned in one embodiment relative to the flexible bladder section 7, flexible liner layer 6, and pressure sensor 8. Additionally, FIG. 3 provides a detailed view of bladder subsections 25 and empty cavities 26 that preferably comprise the flexible bladder section 7.

FIG. 7 depicts an embodiment of the flexible bladder section 7, wherein bladder sections run along the length of a cuff and are situated contiguous with the bottom of the flexible surface layer 1 in such manner that each actuator unit 3 and extension attachment 4 is complimented by a separate portion of flexible bladder section 7. This embodiment is preferable as separate actuators can compress differently on the same cuff, while retaining the support afforded by a separate bladder section. This flexible bladder section 7 arrangement therefore provides support for the portion of the cuff that is compressed on individual actuator activation. FIG. 7 demonstrates with broken lines the location of two separate flexible bladders 7 as they are situated in the same cuff, each bladder contiguous with the bottom of the flexible surface layer 1, and situated beneath an actuator unit 3 and respective extension attachment 4. The top of FIG. 7 shows cross sectional views of two typical flexible bladder section 7 constructions. The cross sectional view 27 on the left side of FIG. 7 is identical to prior descriptions of the flexible bladder section 7 depicted in FIG. 2, except for the difference in orientation of the bladders, namely that separate bladder sections 7 are situated beneath each actuator unit 3 and respective extension attachment 4 on the same cuff. The second cross sectional view 28 depicts a construction wherein the flexible bladder section 7 is continuous throughout (without any subsections across the bladder width) and adapted to receive a fixed volume of fluid, such as water, air, gel, or foam substance. Cross sectional view 28 depicts a continuous construction throughout, meaning without bladder subsections 25 or empty cavities 26 running width-wise, however, a construction as depicted in cross section 28 may still be divided so that on the same cuff flexible bladder section 7 is comprised of separate sections situated beneath each actuator unit 3 and respective extension attachment 4.

Contiguous with the bottom of flexible bladder section 7 is preferably a flexible liner layer 6, that accomplishes friction reduction and sealing of opposite ends of the cuff during activation of the cuff. The liner layer 6 is typically of a construction material having a low coefficient for friction such as Teflon, plastic, nylon, or aramid. Additionally, one or more pressure sensors 8 are typically imbedded or attached to the actuator cuff. Pressure sensors 8 may be imbedded in flexible surface layer 1, flexible liner layer 6, or flexible bladder section 7. Preferably, pressure sensors are connected to the flexible bladder section 7 to monitor air pressure in the bladder. Such sensors are able to detect material strain in the cuff or air pressure in the bladder or pressure, negative and/or positive between the cuff and skin and electronically transmit this information for processing by computer means. The pressure sensors 8 thereby provide electronic feedback data and detect the degree of compression accomplished by the actuator cuff and individual actuators during operation. This data can be interpreted during treatment for adjustment of cuff and actuator activation.

Compression or expansion of the cuff may be correlated with physiological data including, but not limited to EKG, plethysmograph, cardiac output, heart rate, blood pressure, heart stroke volume, blood oxygen levels, systole and diastole. A variety of devices in the medical industry are used to detect and electrically transmit this physiological data from a patient. After such data is collected, it is typically processed within pulsation parameters to determine proper sequence of cuff activation. Such data is received by and processed, typically with a computer and software designed for pulsation. Typically, a computer processes the patient's electronic physiological data as well as electronic feedback data derived from pressure sensors 8 built into the cuffs and can change treatment parameters based on either input from the clinician or from a processor program. These pressure sensors 8 detect and transmit data on the amount of pressure, positive or negative, being applied by the cuff during operation.

When a cuff is applied to a patient, it is typically wrapped around the patient's extremity or lower torso and its ends are fastened together and held tautly with extensions 5. When negative pressure is desired extensions 5 are preferably adjustable rods or rigid strap unless the cuff itself will spring open sufficiently far and sufficiently quickly to provide the desire vacuum effect. When negative pressure is not necessary extension 5 may be a flexible strap, typically a synthetic material such as high strength nylon, having both a layer of tiny hooks and a complementary layer of a clinging pile; so that the two layers of material can be pulled apart or pressed together for easy fastening and unfastening, and for attachment of both ends of the actuator cuff.

The cuff of the present invention operates by electromechanical means to apply pressure, negative or positive. This application of pressure is typically accomplished through use of actuators 3A housed on top of the flexible surface layer 1. Actuators 3A are preferably solenoid devices of either linear or rotary operation. FIG. 1 depicts where actuators units 3 are typically positioned on the present invention. Actuator units 3 are comprised of an actuator 3A, actuator attachment 3B, and the actuator housing 3C. Typically affixed on the top of the flexible surface layer 1 are the actuator units 3, and extensions attachments 4. The present invention preferably has one or more extension attachments 4 more toward one end of the flexible surface layer 1 to which extensions 5 are connected. FIGS. 1, 2, and 3 further depict an opposite end of the flexible surface layer 1 on top of which are one or more actuator units 3. Each of these actuator units 3 is situated across and opposite from extension attachment 4. This arrangement permits for adjustment of extension 5 between the actuator attachment 3B and the extension attachment 4 when the cuff is wrapped around a patient. The actuator attachment 3B is affixed to the actuator 3A that is in turn positioned within the actuator housing 3C. On electromechanical activation to apply positive pressure, the actuators 3A move away from the cuff end (toward the cuffs center), and within the actuator housing 3C which remains stationary. The extensions 5 are attached on one end to the actuator attachment 3B that is attached to the actuator 3A, and on opposite end of the extension 5 to the extensions attachments 4. Consequently, compression movement of the actuators 3A draws extension 5 towards actuators 3A, thereby causing the cuff to constrict. Preferably, the extensions attachments 4 and actuator units 3 have force distribution footings 2 to better resist strain during cuff activation. The force distribution footings 2 are preferably stair-stepped, and pyramidal, in shape.

FIG. 1 further depicts a cuff where the flexible surface layer 1 is shaped to afford contour of fit during activation. Contouring allows the ends of a cuff to fit together smoothly when the cuff is affixed to a patient. Also, contouring of the layers serves to make a more comfortable device for patients because contoured cuff ends will not pinch a patient during operation of the cuff. FIGS. 1 and 2 both show contouring typical of an unfastened flexible surface-layer 1. For example, the flexible surface layer 1 is stepped down from top to bottom along the entire width of the cuff and at a stepped point 12 just beyond the extension attachments 4.

This step decreases the thickness of the flexible surface layer 1 along its entire width making an overlap section 10. At a point closer to the end of the flexible surface layer 1, the thickness is preferably tapered to a point, the tapered end 9. The entire width of the opposite end of the flexible surface layer 1 preferably forms an abrupt taper 11 upward from a point beginning from the bottom of the flexible surface, layer 1 and at a point beyond contact with the flexible bladder section 7.

In an alternative embodiment, a seal at each edge 29 of cuff 23 and the patient (not shown) is created and a seal is created between edge 30 of cuff 23 and edge 31 of cuff 23. As a result of the three seals, a fixed volume of air is created between patient (not shown) and cuff 23. Tensile movement of the actuators 3A forces extension 5 away from actuator 3A, thereby causing the cuff to expand. As the fixed volume of air does not significantly vary, a vacuum is created, reducing the pressure of the fixed volume of air and thereby causing expansion of the patient's limb or member. Such expansion encourages blood flow into the formerly constricted blood vessels which may permit a greater volume of blood to be forced towards the heart during the next constriction sequence and may permit more rapid application of the next constriction sequence.

FIG. 3 is an end view of the electromechanical actuator cuff embodied in FIGS. 1 and 2 as the cuff would appear during use. Opposite ends of the cuff are rolled toward one another in circular fashion for affixation around a patient's body and/or extremities. The entire electromagnetic cuff is flexible, but when placed around a human extremity, would appear primarily circular as pictured. Fit contouring of the flexible surface layer 1 is also shown, including the stepped point 12 which defines a beginning of the flexible overlap section 10, and which further narrows to a tapered end 9. This overlap section 10 wraps around in circular fashion to meet the opposite end of the flexible surface layer 1 that preferably culminates in an abrupt taper 11. The diameter 20 of this fastened cuff will vary in the range of 1.0 and 20.0 inches, variable on activation. FIG. 3 further depicts an extension 5 as it would appear in fixed position between an extension attachment 4 and the actuator attachment 3B.

Figure 4:
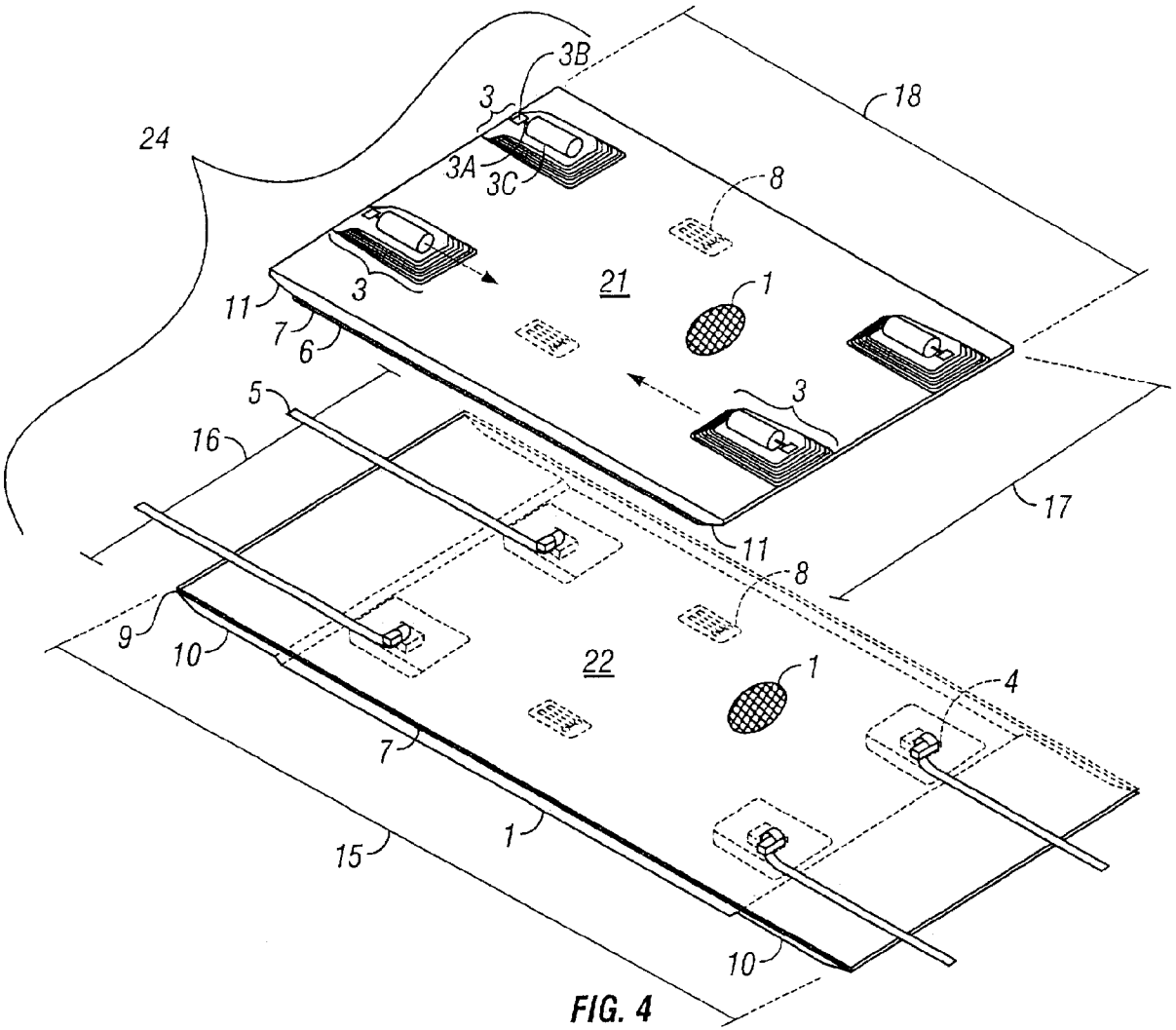
FIG. 4 is an isometric view of an electromechanical actuator cuff comprising an upper and lower section and which is an embodiment of the cuff for use on a patient's lower torso.

FIG. 4 defines a separate embodiment of the electromechanical actuator cuff. This double section cuff 24 embodiment, shown in FIGS. 4, 5, 6 and 6A is designed for affixation to wider parts of a human body such as the torso, thorax, and buttocks. It is, however, possible that such device could be used on the extremities such as arm and legs as part of pulsation, including counterpulsation or simultaneous pulsation, treatment. As with the single section cuff 23 shown in FIGS. 1, 2, and 3, the double section cuff 24 compresses on electromechanical activation, and is designed to correlate with physiological data obtained from a patient, however, this embodiment 24 is comprised of two separate sections. Unlike the first single section cuff 23 that has both actuator units 3 and tension strap attachments 4 affixed to the same flexible surface layer 1, this second embodiment 24 has a plurality actuator units 3 fixed on one upper section 21, and tension strap attachments 4 fixed on a separate lower section 22. The two sections of the cuff fit together and constrict as depicted in FIGS. 6 and 6A. On activation, both upper and lower sections of the cuff move toward one another, constricting, and applying pressure to the portion of the patient's body to which the cuff was affixed.

The two section cuff 24 depicted in FIG. 4 is made up of an upper section 21 and a lower section 22 that are adapted to connect to one another. Both upper section 21 and lower section 22 have a flexible surface layer 1 similar to that in the single section cuff 23, however with different contouring. On both the upper 21 and lower 22 section of the actuator cuff, thickness 19, meaning the sum measurement of either one layer or of a preferable cuff construction comprising a flexible surface layer 1, flexible bladder section 7, and flexible liner layer 6, is its at thickest point between 0.1 and 3.0 inches. As with the single section cuff 23, the upper section 21 and lower 22 sections of the actuator cuff have a preferable flexible surface layer 1 that is made of a material for flexibility, appearance, durability, and strength. The flexible surface layer 1 is typically made from Kevlar, plastic, nylon, aramid, Mylar, a Teflon®-coated material or smooth plastic. The flexible surface layer 1, is preferably made from a resilient construction that will not have significant stretch within the range and duration of the unit's operation. In both the upper 21 and lower 22 sections, contiguous with the bottom of the flexible surface layer 1 is preferably a flexible bladder section 7 that contains a fixed volume of fluid or gel material. The bladder section typically contains fluid such as air, gel, foam substance, or water. The bladder section 7 is flexible so that it bends with the actuator cuff, but does not inflate or deflate pneumatically upon activation of the cuff. As with the single section cuff 23, the bladder section 7 is typically comprised of bladder subsections 25, with empty cavities 26 between each subsection so as to enhance flexibility of the bladder section 7 and cuff as a whole during operation.

In yet another embodiment of the flexible bladder section 7, bladder sections run along the length of each cuff and are situated contiguous with the bottom of the flexible surface layer 1 in such a manner that a pair of actuator units 3 of the upper section 21 and respective pair of extensions attachments 4 of the lower section 22 are supported by a portion of flexible bladder section 7 running longitudinally on one side of each cuff section. Flexible bladder sections on each side of separate lower 22 and upper 21 sections work together providing support independent of support provided by the flexible bladder section 7 portion situated on an opposite side of the same cuff for separate respective actuator units 3 and extension attachments 4.

FIG. 7 shows cross sectional views of two typical flexible bladder section 7 constructions on the single section cuff embodiment 23 that are useful for showing the same embodiment on the double section cuff embodiment 24. The cross sectional view 27 on the left side of FIG. 7 is identical to prior descriptions of the flexible bladder section 7 depicted in FIG. 2, except for the difference in orientation of the bladders. The flexible bladder section 7 is divided into two sections that run longitudinally along the side of each cuff so as to support a pair of actuator units 3 (if on the upper section 21) or a pair of extension attachments 4 (if on the lower section 22). The second cross sectional view 28 depicts a construction wherein the flexible bladder section 7 is continuous throughout (without any subsections across the bladder width) and adapted to receive a fixed volume of fluid, such as water, air, gel, beads (typically plastic), or foam substance. Cross sectional view 28 depicts a continuous construction throughout, meaning without bladder subsections 25 or empty cavities 26 running width-wise, however, a construction as depicted in cross section 28 may still be divided so that each cuff section (both upper and lower) preferably have a flexible bladder section 7 comprised of separate sections situated beneath each actuator unit 3 and respective extension attachment 4.

As with the single section cuff 23, and in both upper 21 and lower 22 sections of the cuff, contiguous with the bottom of the flexible bladder section 7 is preferably a flexible liner layer 6 that accomplishes friction reduction and sealing ends of the cuff during activation of the cuff. This liner layer 6 is typically made of Kevlar, Mylar, a Teflon®-coated material or smooth plastic. The liner layer 6 is typically of a construction material having a low coefficient for friction. Preferably, in both upper section 21 and lower section 22 of the actuator, one or more pressure sensors 8 are imbedded in the actuator cuff. Sensors 8 are able to detect material strain in the cuff or pressure, negative and/or positive between the cuff and skin or in bladder section 7 and transmit this information for processing. The pressure sensors 8 thereby detect the amount of pressure applied accomplished by the actuator cuff during operation. Pressure sensors 8 are imbedded in flexible surface layer 1, flexible liner layer 6, or attached to the flexible bladder section 7. Preferably, pressure sensors 8 are connected to the bladder section 7 next to the liner layer 6. The electromechanical mechanism in the double section cuff embodiment 24 is essentially the same as that with the single section cuff embodiment 23, however, with a difference being that actuator units 3 and extension attachments 4 are not affixed to the same surface on the second cuff embodiment 24.

Figures 5A, 5B, 5C, 5D:
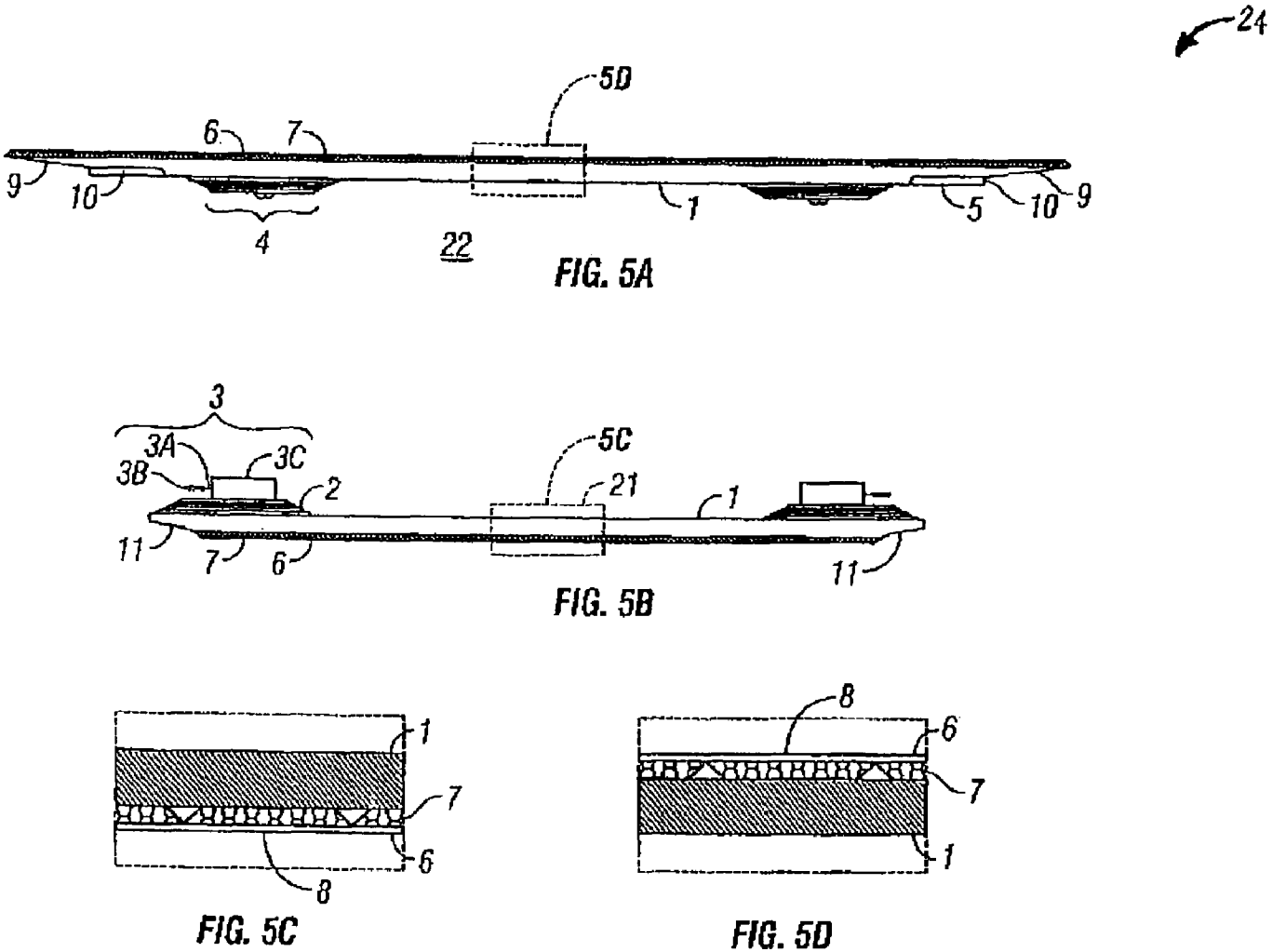
FIG. 5 is an end view of the electromechanical actuator cuff depicted in FIG. 4 and additionally provides sectional views.

In this two section cuff embodiment 24, on the top of the flexible surface layer 1 of the upper section 21 are a plurality of actuator units 3, and contained actuator attachments 3B. All of the extension attachments 4, however, are on the lower section 22 of the cuff and attached to the flexible surface layer 1 on the side opposite the flexible bladder section 7. As depicted in FIGS. 4 and 5, the lower section 22 has a plurality of extension attachments 4 from which are attached a plurality of extensions. Extensions are adapted at one end to be received by the actuator units 3, and contained actuator attachments 3B on the upper section 21 of the actuator cuff. Opposite ends of the extensions are adapted to be received by extension attachments 4 fixed on the cuffs lower section 22. Actuator units 3 and extension attachments 4 have force distribution footings 2. On operation of the two section cuff 24, the actuators 3A move to or away from the center of the upper section 21 and pull extensions which are connected to extension attachments 4 on the lower section 22 of the two section cuff 24. As a result, the upper section 21 and lower section 22 constrict or expand, applying pressure, positive or negative, to a patient at the point where the cuff is affixed on the patient's body.

Both the lower section 22 and upper sections 21 of the cuff have similar construction, usually a flexible surface layer 1, flexible bladder section 7, pressure sensor 8, and flexible liner layer 6. The upper section 21 and lower section 22 are different in terms of their geometric dimensions (length and width) and with regard to fit contours of their respective flexible surface layers 1. FIG. 4 shows the lower section 22 of the cuff is typically defined on opposite ends of its length by a stepped point 12 from which point the thickness of its flexible surface layer 1 is decreased (as in the first cuff embodiment); forming an overlap section 10; and where the overlap section 10 continues and preferably culminates with a tapered end 9. Opposite ends of the lower section 22 mirror one another from a hypothetical midline across the lower section's width. The lower section width 16 is in the range of 2.0 and 20.0 inches and the longest lower section length 15 is in the range of 10.0 and 40.0 inches. The upper section 21 in FIG. 4 is different from the lower section 22 in terms of dimension and fit contouring of the flexible surface layer 1. The upper section width 17 is in the range of 2.0 and 20.0 inches and the upper section length 18 is in the range of 5.0 and 30.0 inches. The upper section 21 has preferably an abrupt taper 11 that extends along the entire width of opposite ends. Such abrupt tapers 11 begin typically on the flexible surface layer 1 at each end at a point beyond contact with the flexible bladder section 7. The abrupt taper 11 depicted in FIGS. 4 and 5 on the upper section 21 is identical to the abrupt taper depicted in *Figure* 1.

FIG. 5 is an end view of the electromechanical actuator cuff depicted in FIG. 4 and additionally provides sectional views.

FIG. 6 provides an end view of the electromechanical actuator cuff in FIGS. 4 and 5 as the cuff would appear during use when the upper 21 and lower 22 sections are fit together around a patient. The extensions are shown as they appear when fixed between the actuator attachment 3B and extension attachment 4. FIG. 6 additionally depicts how contouring of the flexible surface layers 1 of both upper 21 and lower 22 sections accomplishes a smooth fit between parts. The flexible surface layer 1 of the lower section 22 forms an overlap section 10 from a stepped point 12 and culminates with a tapered end 9. On electrical activation, the actuators 3A and actuator attachments 3B move away from the upper section 21 ends and toward the center or in the opposite direction. When the actuators 3A and actuator attachments 3B move away from the upper section 21 ends and toward the center the extensions tighten and the upper 21 and lower 22 sections of the cuff constrict. In reverse, the cuff applies pressure. A pressure sensor 8 as shown in FIG. 6 detects the amount of material strain in the cuff or pressure, negative and/or positive between the cuff and skin in the cuff or pressure in the bladder and electronically transmits data regarding the cuffs action. Both upper 21 and lower 22 sections contain pressure sensors 8.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A cuff for use in pulsation treatment of a patient wherein pressure is applied to and released from a patient's blood vessels to stimulate blood flow correlated with a user's physiological data based on data received from at least one physiological measuring device, comprising:

a. a cuff having a first edge, a second edge, a third edge, a fourth edge, a top side and a bottom side, said cuff sized to fully encircle a body art of said user such that said bottom side contacts said user peripherally;

b. said cuff having at least one electromechanical actuator integral to said cuff, said actuator being proximate said first edge and fixedly attached to said top side, said actuator being rigidly attached to an actuator attachment, said actuator attachment being attached to a extension attachment, said actuator being distant from said extension attachment, said extension attachment being rigidly attached to said cuff at said top side proximate said second edge; said actuator being controllably operable to a plurality of positions;

c. said plurality of positions being within a range of positions;

d. said range of positions ranging from an original position to a maximum constricted position;

e. said distance between said electromechanical actuator and said extension attachment in said original position being greater than said distance in said constricted position;

f. said cuff applying maximum positive pressure to said user's blood vessels to constrict said blood vessels in said maximum constricted position of said plurality of positions of said actuator;

g. said distance directly related to each position of said electromechanical actuator in said range of positions;

i. said electromechanical actuator controllably operable from said relaxed position to any of said positions within said range of positions; and j. said electromechanical actuator operable at variable frequency, at least one said frequency responsive to at least one said physiological datum.

2. The cuff as described in claim 1 wherein said cuff is rectangular or trapezoidal in shape to accommodate increasing or decreasing thickness of user extremities.

3. The cuff as described in claim 1 wherein said cuff further comprises a flexible bladder contiguous to said bottom side.

4. The device as in claim 3, wherein each said actuator unit and each said extension attachment has a force distribution footing.

5. The device as in claim 3, wherein:

said cuff further comprises a flexible surface layer;

said flexible surface layer is decreased in thickness at a stepped point along an entire width of one end forming an overlap section which continues until the surface layer becomes a tapered point; and the entire width of an opposite end of said flexible surface layer defines an abrupt taper upward from a point beyond a contact with said flexible bladder.

6. The device as in claim 3, wherein:

said cuff further comprises a flexible surface layer and a flexible liner layer;

said flexible bladder is intermediate said flexible surface layer and said flexible liner layer; and the sum thickness of the said flexible surface layer, said flexible bladder, and said flexible liner layer is between 0.1 and 3.0 inches at the thickest point.

7. The device as in claim 3, wherein a cuff width is in the range of 1.0 and 20.0 inches.

8. The device as in claim 3, wherein length of the cuff is in the range of 4.0 and 40.0 inches.

9. The device as in claim 3, wherein said cuff further comprises a flexible liner layer, wherein a diameter of an affixed actuator cuff as measured from said flexible liner layer is in the range of 1.0 and 12.0 inches.

10. The device as in claim 3 wherein said flexible bladder further comprises a plurality of bladder subsections with a plurality empty cavities between each said subsection.

11. The device in claim 10 wherein said pulsation comprises counterpulsation.

12. The device in claim 10 wherein said pulsation comprises simultaneous pulsation.

13. The device in claim 1 wherein said pulsation comprises counterpulsation.

14. The device in claim 1 wherein said pulsation comprises simultaneous pulsation.

15. The device as in claim 1 wherein said cuff contains a pressure sensor.

16. A method of treating a medical condition using pulsation comprising the steps of:

a. applying a cuff to a patient, said cuff having a first edge, a second edge, a third edge, a fourth edge, a top side and a bottom side, said cuff sized to fully encircle a body part of said patient such that said bottom side contacts said patient peripherally;

said cuff having at least one electromechanical actuator integral to said cuff, said actuator being adjacent first edge and fixedly attached to said top side, said actuator being rigidly attached to an actuator attachment, said actuator attachment being attached to a extension attachment, said actuator being distant from said extension attachment, said extension attachment being rigidly attached to said cuff at said top side adjacent said second edge; said actuator being controllably operable to a plurality of positions; said plurality of positions being within a range of positions;

said range of positions ranging from an original position to a maximum constricted position;

said distance between said electromechanical actuator and said extension attachment in said original position being greater than said distance in said constricted position;

said cuff applying maximum positive pressure to said patient's blood vessels to constrict said blood vessels in said maximum constricted position of said plurality of positions of said actuator;

said distance directly related to each position of said electromechanical actuator in said range of positions;

said electromechanical actuator unit controllably operable from said relaxed position to any of said positions within said range of positions on activation;

said cuff having an internal bladder which may be inflated to a desired volume to expand thickness of said cuff;

said bladder communicating with an external source of inflating liquid;

said bladder having a pressure relief valve;

said cuff having a pressure sensor for communicating with an external processor;

b. applying medical devices to said patient to detect physiological data;

c. detecting physiological data from said patient through use of said medical devices;

d. transmitting said physiological data electronically from said medical devices to a processor;

e. detecting said pressure data in said bladder, f. transmitting said pressure data from said pressure sensor to a pressure data processor;

g. electronically processing said pressure data to determine and effect optimal pressure in said cuff;

h. inflating said bladder until desired pressure is obtained;

i. electronically processing said physiological data to determine when the patients heart is in a diastolic or a systolic phase;

j. electronically timing said activation of said cuff to correlate with the phases of the patient's heart;

l. modifying said pressure according to changes in said physiological data affected by said activation; and k. modifying said timing of said activation of said cuff according to changes in said physiological data affected by said activation.

17. The device in claim 16 wherein said pulsation comprises counterpulsation.

18. The device in claim 16 wherein said pulsation comprises simultaneous pulsation.

* * * * *